US009523957B2

(12) United States Patent
Kawabata et al.

(10) Patent No.: US 9,523,957 B2
(45) **Date of Patent: *Dec. 20, 2016**

(54) IMAGE FORMING APPARATUS WITH ROLLERS CONFIGURED TO RESET THE LATERAL POSITION OF A SHEET

(71) Applicant: Konica Minolta, Inc., Chiyoda-ku, Tokyo (JP)

(72) Inventors: Shinichi Kawabata, Tokyo (JP); Yusuke Kawanago, Tokyo (JP); Takahiro Okubo, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/928,455

(22) Filed: Oct. 30, 2015

(65) Prior Publication Data

US 2016/0048101 A1 Feb. 18, 2016

Related U.S. Application Data

(63) Continuation of application No. 14/331,795, filed on Jul. 15, 2014, now Pat. No. 9,207,619.

(30) Foreign Application Priority Data

Jul. 17, 2013 (JP) ..... 2013-148292

(51) Int. Cl.
*G03G 15/00* (2006.01)
*B65H 9/00* (2006.01)

(52) U.S. Cl.
CPC ..... *G03G 15/6561* (2013.01); *B65H 9/002* (2013.01); *G03G 15/55* (2013.01);
(Continued)

(58) Field of Classification Search
CPC G03G 15/55; G03G 15/6558; G03G 15/6561; G03G 15/6567; G03G 2215/00561; B65H 9/00; B65H 9/002
See application file for complete search history.

(56) References Cited

U.S. PATENT DOCUMENTS 4,602,778 A 7/1986 Hirose et al.
4,627,721 A 12/1986 Nguyen et al.
(Continued)

FOREIGN PATENT DOCUMENTS

JP 2007022680 A 2/2007
JP 2013006643 A 1/2013

OTHER PUBLICATIONS

United States Ex Parte Quayle Action corresponding to U.S. Appl. No. 14/331,795; Date of Mailing: Mar. 23, 2015.
(Continued)

*Primary Examiner* — Blake A Tankersley
(74) *Attorney, Agent, or Firm* — Cantor Colburn LLP

(57) ABSTRACT

An image forming apparatus includes: an image forming section; a pair of rollers; a displacement detection section; a displacement correction section; a translation amount determination section; and a control section configured to refer to a translation control table, operate the displacement correction section in accordance with a translation command value corresponding to a detection result obtained by the displacement detection section, obtain at a predetermined timing a relationship between the translation command value and a translation amount of the sheet, and update the translation control table on the basis of the relationship. The control section updates the translation control table when a displacement of a sheet is correctable, but does not update the translation control table when a displacement of a sheet is correctable.

7 Claims, 10 Drawing Sheets

(52) U.S. Cl.
CPC ..... *G03G 15/6558* (2013.01); *G03G 15/6567* (2013.01); *G03G 2215/00561* (2013.01)

(56) References Cited

U.S. PATENT DOCUMENTS

| | | | | |
|---|---|---|---|---|
| 6,634,521 | B1 | 10/2003 | Hwang | |
| 9,207,619 | B2 * | 12/2015 | Kawabata ..... | G03G 15/6561 |
| 2012/0327444 | A1 | 12/2012 | Kawanago | |

OTHER PUBLICATIONS

Japanese Notice of Reasons for Rejection corresponding to Application No. 2013-148292; Dispatch Date Sep. 1, 2015, with English translation.

* cited by examiner

IMAGE FORMING APPARATUS WITH ROLLERS CONFIGURED TO RESET THE LATERAL POSITION OF A SHEET

CROSS REFERENCE TO RELATED APPLICATIONS

The present application is a continuation application of U.S. patent application Ser. No. 14/331,795, filed on Jul. 15, 2014, the entire contents of which are incorporated herein by reference and priority to which is hereby claimed. Priority under 35 U.S.C. §119(a) and 35 U.S.C. §365(b) is hereby claimed from Japanese Application No. No. 2013-148292, filed on Jul. 17, 2013, the disclosure of which is also incorporated herein.

BACKGROUND OF THE INVENTION

1. Field of the Invention

The present invention relates to an electrophotographic image forming apparatus.

2. Description of Related Art

In general, an electrophotographic image forming apparatus (such as a printer, a copy machine, and a fax machine) is configured to irradiate (expose) a charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing, whereby an image is formed on the sheet.

The above-described image forming apparatus includes a sheet feed tray, a sheet conveyance section that conveys to an image forming section a sheet fed from a manual feed tray or an external sheet feeding device. In the sheet conveyance section, a plurality of conveyance rollers such as intermediate conveyance rollers, loop rollers, and rollers are disposed, for example.

When a sheet is conveyed by the conveyance section, the sheet may be displaced in a lateral direction of the sheet (a horizontal scanning direction, or a direction orthogonal to a sheet conveyance direction). The cause of this displacement includes, for example, an axially nonuniform roller diameter due to errors in manufacture, a variation in roller diameter due to aging degradation, a displaced sheet stored in the sheet feed tray, and the like. When an image formation is performed with the laterally displaced sheet described above, the image forming region on the sheet is deviated.

To solve such a problem, a method for correcting the displacement by using a registration translation has been proposed as a method for accurately aligning an image with a sheet in consideration of the lateral displacement of the sheet (see, for example, Japanese Patent Application Laid-Open Nos. 2007-22680 and 2013-6643). To be more specific, a displacement of a sheet is corrected in such a manner that rollers tightly sandwiching the sheet conveys the sheet while translating in the lateral direction of the sheet (the axis direction of the rollers).

This registration translation operation is performed based on detection results (a displacement amount and deviation from a reference position) obtained by displacement detection sensor 85 (a line sensor for example) disposed on the downstream side of rollers R in the sheet conveyance direction (see FIG. 1). As illustrated in FIG. 1, when the position of a sheet which is not laterally displaced is set as a reference position and the detection value obtained by displacement detection sensor 85 at this time is represented by detection reference value X0, displacement amount ΔX of a conveyed sheet is expressed by detection reference value X0—detection value Xi. In FIG. 1, the position of the conveyed sheet is displaced to—side (right side in FIG. 1) relative to the reference position by ΔX. Displacement amount ΔX is a translation amount (hereinafter referred to as "required translation amount") required to put the sheet back to the reference position.

In this case, rollers R are translated to + side (left side in FIG. 1) so as to align the left end of the sheet in the lateral direction with an end of the reference position. At this time, when the sheet has a high translation responsiveness (followability) to rollers R and the sheet is translated by the same amount as rollers R, it is only necessary to translate rollers R to the left side by displacement amount ΔX.

However, in practice, the translation amount of rollers R based on a translation command value and the actual translation amount (measured value) of a sheet do not match. The translation responsiveness is varied by a conveyance path on the upstream side of the roller section in the sheet conveyance direction, looseness of a driving mechanism, and/or a load during driving. For example, in FIG. 2, inclinations a1 and a2 of lines L representing the translation responsiveness depend on the sheet type and the conveyance path, and intercepts b1 and b2 depend on the looseness of the driving mechanism and the load during driving. Here, the "translation command value" is information (pulse signal) which is input to a drive motor of rollers R so as to translate rollers R by a predetermined translation amount. The terms "translation command value" and "registration amount of rollers" used herein have the same meaning.

Generally, as illustrated in FIG. 2, the translation responsiveness is such that the translation amount of a sheet is smaller than that of the rollers. For example, according to the translation responsiveness in FIG. 2, when the translation command value is set at "+4 mm" and the rollers are translated by +4 mm, the actual translation amount of a sheet is "+3 mm."

Under such circumstances, in the conventional image forming apparatus, a look-up table (hereinafter referred to as "translation control table") indicating the relationship between a required translation amount and a translation command value (translation amount of the rollers) is prepared, and the translation command value is determined based on the translation control table, thereby translating a sheet by the desired amount. As illustrated in FIG. 3, the translation control table is defined by translation control line M expressed by an inverse function of line L representing the translation responsiveness. According to the translation control table defined by translation control line M, when the required translation amount is "3 mm to the + side," the translation command value is "4 mm to + side," for example.

Translation control line M is obtained in such a manner that, at the manufacturing stage of an image forming apparatus, a plurality of sheets are actually conveyed while being laterally displaced and the actual translation amount (measured value) of the sheets in the case where the translation command value is set in accordance with the displaced amount is measured to compute translation response line L, for example.

Incidentally, when rollers and/or bearings of the rollers are degraded due to abrasion, the nip pressure of the rollers decreases, and/or the looseness of the driving mechanism increases, and thus, the translation responsiveness decreases with time (see FIG. 2). However, the translation control table is set at the manufacturing stage of the image forming apparatus, and the variation of the translation responsiveness with time is not taken into consideration. That is, when the translation responsiveness is varied due to the operating condition (such as the number of printed sheets) of the image forming apparatus and the like, sheets may not be translated by the required translation amount even when the rollers are translated in accordance with the initially set translation control table, and thus the displacement correction may not be appropriately performed.

Conventionally, the components of a registration translation mechanism including rollers and bearings of the rollers are replaced according to a running condition set in advance (for example, the total number of printed sheets is 1,000,000) to deal with variation of the translation responsiveness with time. However, depending on the use environment, the components of the registration translation mechanism are replaced even when they are still usable, thus resulting in increase in cost per print (CPP).

SUMMARY OF THE INVENTION

An object of the present invention is to provide an image forming apparatus capable of limiting increase in CPP, as well as achieving an appropriate displacement correction even when the components of the apparatus is degraded because of the operating condition, and a precise alignment of an image with a sheet.

To achieve the abovementioned object, an image forming apparatus reflecting one aspect of the present invention includes: an image forming section configured to form an image on a sheet; a pair of rollers disposed on an upstream side of the image forming section in a sheet conveyance direction, the rollers being configured to convey the sheet to the image forming section; a displacement detection section configured to detect a lateral position of the sheet passing between the rollers; a displacement correction section configured to translate the rollers in a lateral direction of the sheet, and reset the lateral position of the sheet to a reference position; a translation amount determination section configured to determine a translation amount of the sheet during a displacement correction performed by the displacement correction section; and a control section configured to refer to a translation control table in which a required translation amount for resetting the sheet to the reference position and a translation command value for operating the displacement correction section to translate the sheet by the required translation amount are associated with each other, operate the displacement correction section in accordance with a translation command value corresponding to a detection result obtained by the displacement detection section, obtain at a predetermined timing a relationship between the translation command value and a translation amount of the sheet, and update the translation control table on the basis of the relationship, wherein, when updating the translation control table, the control section determines whether a displacement of a sheet in a certain range is correctable by the update of the translation control table, and the control section updates the translation control table when the displacement of the sheet is correctable, but does not update the translation control table when the displacement of the sheet is not correctable.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, an embodiment of the present invention will be described in detail with reference to the accompanying drawings.

Figure 4:
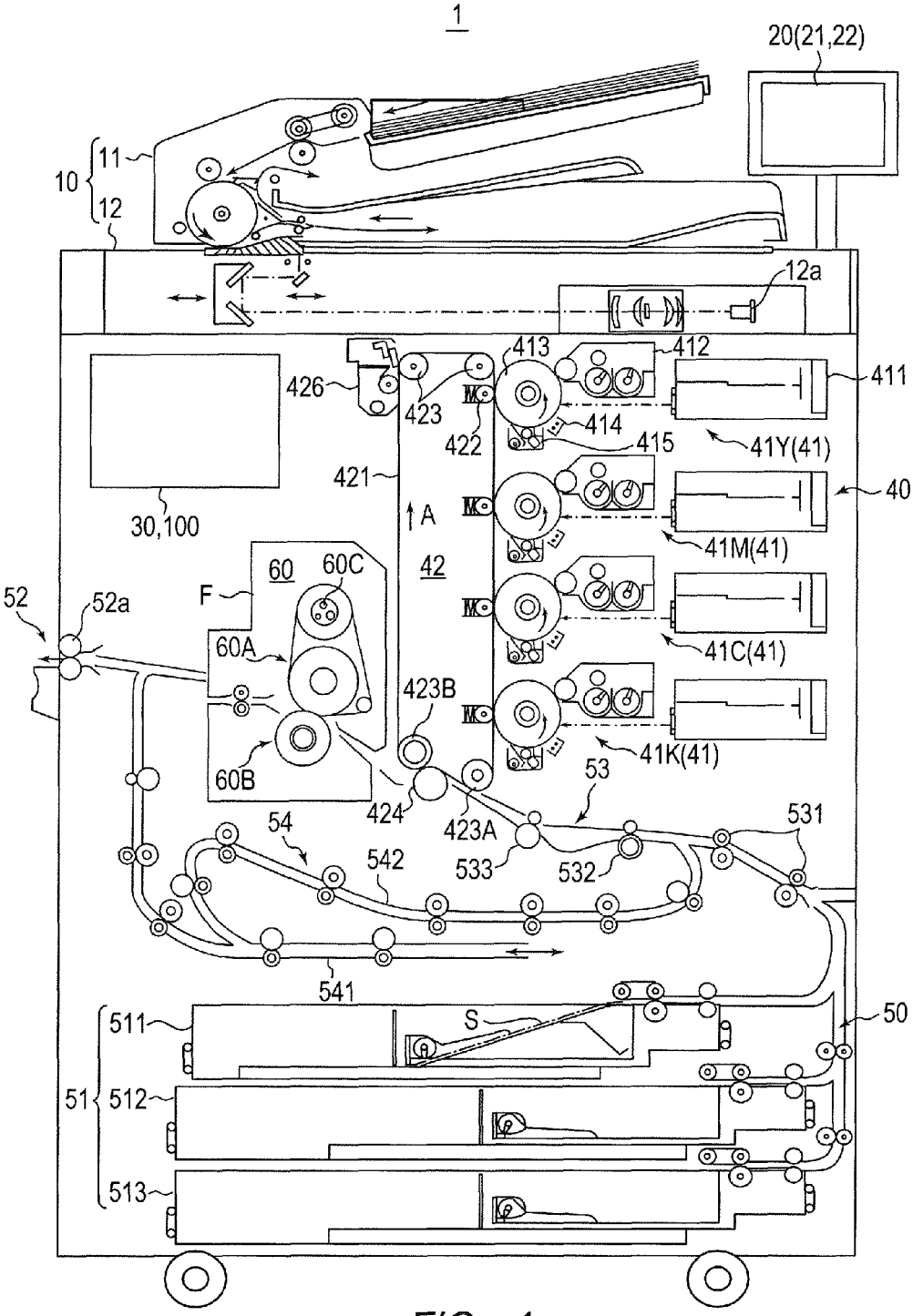
FIG. 4 illustrates a general configuration of an image forming apparatus according to an embodiment of the present invention.
Figure 5:
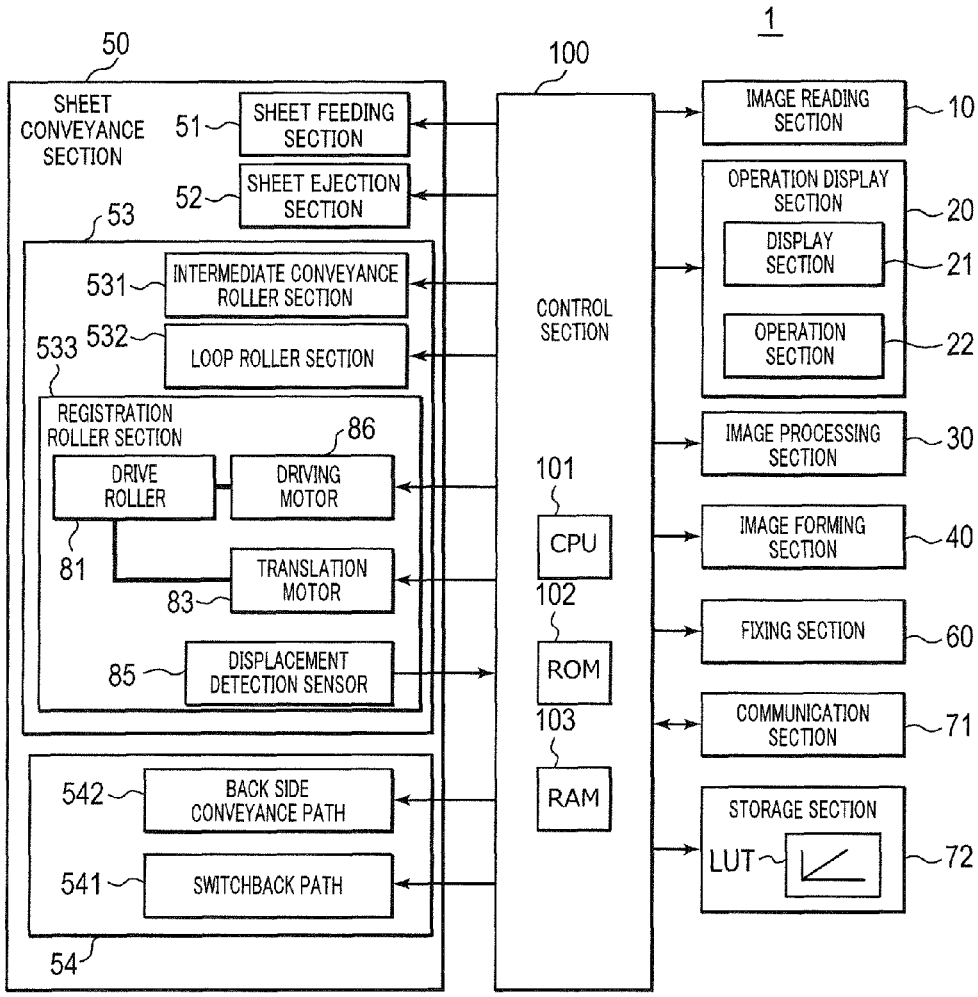
FIG. 5 illustrates a principal part of a control system of the image forming apparatus according to the embodiment.

FIG. 4 illustrates an overall configuration of image forming apparatus 1 according to the embodiment of the present invention. FIG. 5 illustrates a principal part of a control system of image forming apparatus 1 according to the embodiment.

Image forming apparatus 1 illustrated in FIGS. 4 and 5 is a color image forming apparatus with an intermediate transfer system using electrophotographic process technology. A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to a sheet, thereby forming an image.

As illustrated in FIGS. 4 and 5, image forming apparatus 1 includes image reading section 10, operation display section 20, image processing section 30, image forming section 40, sheet conveyance section 50, fixing section 60, and control section 100.

Control section 100 includes central processing unit (CPU) 101, read only memory (ROM) 102, random access memory (RAM) 103 and the like. CPU 101 reads a program suited to processing contents out of ROM 102 or storage section 72, develops the program in RAM 103, and integrally controls an operation of each block of image forming apparatus 1 in cooperation with the developed program.

Storage section 72 is composed of, for example, a non-volatile semiconductor memory (so-called flash memory) or a hard disk drive. Storage section 72 stores therein look-up tables LUT which is referenced when the operation of each block is controlled, for example. Look-up tables LUT include a translation control table which is referenced during a displacement correction process. In the translation control table, a required translation amount and a translation command value for operating the displacement correction section such that a sheet is translated by the required translation amount are associated with each other. The translation control table is set at the manufacturing stage of image forming apparatus 1, and is appropriately updated in accordance with the operating condition (for example, the total number of printed sheets) of image forming apparatus 1.

The translation control table includes data which is referenced when an image is formed on the first surface (front surface) of the sheet, and data which is referenced when an image is formed on the second surface (rear surface) of the sheet. When an image is formed on the second surface, the sheet is conveyed through second conveyance section 54 after an image is formed on the first surface, and thus the sheet may be curled. Thus, when the condition of the sheets passed through rollers R varies between the case of the image formation on the first surface of the sheet and the case of the image formation on the second surface, the translation responsiveness of the sheets varies, and therefore the translation control tables is prepared for each case.

The translation responsiveness varies also depending on the type of sheets (such as basis weight and sheet size) used for the image formation, and the use condition (LL: low temperature and low humidity (10° C., 20% RH), NN: normal temperature and normal humidity (20° C., 50% RH), and HH: high temperature high humidity (30° C., 80% RH)), and therefore, the translation control table is prepared for each case. The sheet type is the type of sheet such as plain paper, coated paper, and matte paper, and is classified according to the basis weight, sheet size, thickness, stiffness, and/or the like.

Control section 100 transmits and receives various data to and from an external device (for example, a personal computer) connected to a communication network such as a local area network (LAN) or a wide area network (WAN), through communication section 71. Control section 100 receives page description language (PDL) sent from an external device, and controls the apparatus to form an image on a sheet on the basis of the image data (input image data) contained in the PDL, for example. Communication section 71 is composed of various interfaces including, for example, network interface card (NIC), modulator-demodulator (MODEM), universal serial bus (USB), and the like.

Image reading section 10 includes auto document feeder (ADF) 11, document image scanner (scanner) 12, and the like.

Auto document feeder 11 causes a conveyance mechanism to feed documents placed on a document tray, and sends out the documents to document image scanner 12. Auto document feeder 11 enables images (even both sides thereof) of a large number of documents placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, thereby reading the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

By operating operation display section 20, the user can perform setting relating to the image formation such as document setting, image quality setting, multiplying factor setting, application setting, output setting, single-sided/duplex printing setting, sheet setting, and translation amount adjustment.

Image processing section 30 includes a circuit that performs digital image processing suited to initial settings or user settings, on the input image data, and the like. For example, image processing section 30 performs tone correction on the basis of tone correction data (tone correction table), under the control of control section 100 (image density control). Image processing section 30 also performs various correction processes such as color correction and shading correction as well as a compression process, on the input image data. Image forming section 40 is controlled on the basis of the image data that has been subjected to these processes.

Image forming section 40 includes: image forming units 41 for images of colored toners respectively containing a Y component, an M component, a C component, and a K component on the basis of the input image data; intermediate transfer unit 42; and the like. The writing range within which an image is to be formed by image forming section 40 is set in advance.

Image forming unit 41 includes image forming units 41Y, 41M, 41C, and 41K for the Y component, the M component, the C component, and the K component. Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 4, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415, and the like.

Photoconductor drum 413 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum.

The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 414 is composed of a corona discharging generator such as a scorotron charging device and a corotron charging device, for example. Charging device 414 evenly negatively charges the surface of photoconductor drum 413 by corona discharge.

Exposure device 411 is composed of, for example, a semiconductor laser. Exposure device 411 irradiates photoconductor drum 413 with laser light corresponding to the image of each color component. The positive charge generated in the charge generation layer of photoconductor drum 413 is transported to the surface of the charge transport layer, whereby the surface charge (negative charge) of photoconductor drum 413 is neutralized. Thus, an electrostatic latent image of each color component is formed on the surface of photoconductor drum 413 by the potential difference from its surroundings.

Developing device 412 stores developers of respective color components (for example, two-component developers composed of toner having a small particle size and magnetic carrier). Developing device 412 attaches the toners of respective color components to the surface of photoconductor drum 413, and thus visualizes the electrostatic latent image to form a toner image. To be more specific, a developing bias voltage is applied to a developer bearing member (developing roller), and, by the potential difference between the surface of photoconductor drum 413 and the developer bearing member, the charged toner on the developer bearing member is moved and attached to a light-exposed part of the surface of photoconductor drum 413. It is to be noted that developing device 412 will be described in detail later.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer rollers 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt in a primary transfer section can be easily maintained at a constant speed. When driving roller 423A rotates, intermediate transfer belt 421 travels in an arrow A direction at a constant speed.

Primary transfer rollers 422 are disposed on the inner periphery side of intermediate transfer belt 421 in such a manner as to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face roller 423B (backup roller) disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to a sheet is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge opposite to that of the toner is applied to the rear side (the side that makes contact with primary transfer rollers 422) of intermediate transfer belt 421, whereby the toner image is electrostatically transferred to intermediate transfer belt 421.

Thereafter, when the sheet passes through the secondary transfer nip, the toner image on intermediate transfer belt 421 is secondary-transferred to the sheet. To be more specific, a secondary transfer bias is applied to secondary transfer roller 424, and an electric charge opposite to that of the toner is applied to the rear side (the side that makes contact with secondary transfer roller 424) of the sheet, whereby the toner image is electrostatically transferred to the sheet. The sheet on which the toner image has been transferred is conveyed toward fixing section 60.

Belt cleaning device 426 includes a belt cleaning blade configured to make sliding contact with the surface of intermediate transfer belt 421, and the like, and removes a transfer residual toner remaining on the surface of intermediate transfer belt 421 after the secondary transfer.

Alternatively, in intermediate transfer unit 42, it is also possible to adopt a configuration (so-called belt-type secondary transfer unit) in which a secondary transfer belt is installed in a stretched state in a loop form around a plurality of support rollers including a secondary transfer roller.

Fixing section 60 includes upper fixing section 60A having a fixing side member disposed on a fixing surface (the surface on which a toner image is formed) side of a sheet, lower fixing section 60B having a back side supporting member disposed on the rear surface (the surface opposite to the fixing surface) side of the sheet, heating source 60C, and the like.

When upper side fixing section 60A is of a belt heating type (see FIG. 4), the fixing belt serves as the fixing side member, and when upper side fixing section 60A is of a roller heating type, the fixing roller serves as the fixing side member. In addition, when lower side fixing section 60B is of a roller pressing type (see FIG. 4), the pressure roller serves as the back side supporting member, and when lower side fixing section 60B is of a belt pressing type, the pressing belt serves as the back side supporting member. The back side supporting member is brought into pressure contact with the fixing side member, whereby a fixing nip for conveying a sheet in a tightly sandwiching manner is formed.

At the fixing nip, fixing section 60 applies heat and pressure to a sheet on which a toner image has been secondary-transferred, thereby fixing the toner image on the sheet. Fixing section 60 is disposed as a unit in fixing part F. In addition, fixing part F may be provided with an air-separating unit that blows air to separate a sheet from the fixing side member or the back side supporting member.

Sheet conveyance section 50 includes sheet feeding section 51, sheet ejection section 52, first conveyance section 53, second conveyance section 54, and the like.

Three sheet feed tray units 511 to 513 making up of sheet feeding section 51 store therein sheets (standard sheets, special sheets) discriminated on the basis of the basis weight, the size, and the like, for each type set in advance.

First conveyance section 53 has a plurality of conveyance roller sections including intermediate conveyance roller sections 531, loop roller section 532, and roller section 533. First conveyance section 53 conveys a sheet fed from sheet feeding section 51, or an external sheet feeder (not illustrated) to image forming section 40 (secondary transfer section).

Loop roller section 532 includes a pair of loop rollers. Loop roller section 532 conveys a sheet fed from intermediate conveyance roller section 531 disposed on the upstream side and feeds the sheet to roller section 533 disposed on the downstream side. Loop roller section 532 bends the sheet in a loop forming section between loop roller section 532 and roller section 533.

Roller section 533 includes a pair of rollers (drive roller 81 and driven roller 82). Roller section 533 is disposed on the upstream side of image forming section 40 (secondary transfer section), and the downstream side of loop roller section 532. Roller section 533 corrects skew of sheets and the lateral (horizontal scanning direction) position of sheets.

Second conveyance section 54 includes back side conveyance path 542 and switchback path 541 in which a plurality of conveyance roller sections are disposed. Second conveyance section 54 once conveys the sheet to switchback path 541, and then performs a switchback to convey the sheet to back side conveyance path 542, thus inverting the sheet. Thereafter, second conveyance section 54 feeds the sheet to first conveyance section 53 (the upstream of loop roller section 532).

The sheet fed from sheet feeding section 51 or an external sheet feeder (not illustrated) is conveyed to image forming section 40 by first conveyance section 53. At this time, even after the leading edge of the sheet has reached roller section 533, the conveyance of sheets by loop roller section 532 is continued with the rotational driving of roller section 533 (drive roller 81) being stopped. Thus, a state where the leading edge of the sheet is striking the registration nip is established, causing deflection of the sheet in the loop forming section. As a result, skew of the sheet is corrected by the stress exerted on the sheet.

After the skew of the sheet is corrected, the sheet conveyance of roller section 533 (rotational driving of drive roller 81) is started and the sheet is conveyed toward the transfer nip of image forming section 40. At this time, when a displacement of the sheet is detected by displacement detection sensor 85, the lateral position of the sheet is corrected during the process of the sheet conveyance of roller section 533 (registration translation).

Thereafter, a toner image on intermediate transfer belt 421 is secondary-transferred to one side (front surface) of the sheet at one time at the time when the sheet passes through the transfer nip, and then a fixing process is performed in fixing section 60. The sheet on which an image has been formed is ejected out of the image forming apparatus by sheet ejection section 52 provided with sheet discharging roller 52*a*.

Figure 6:
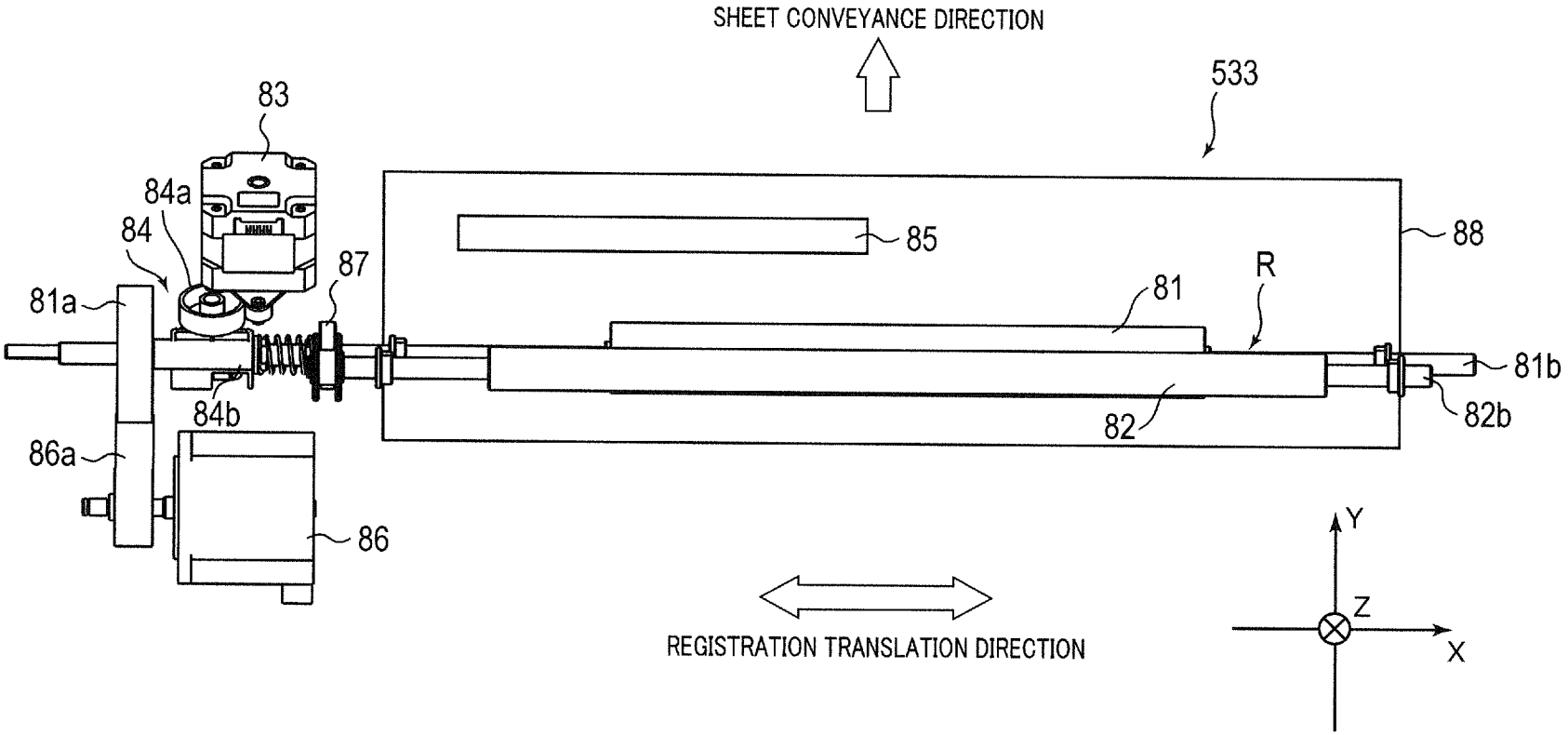
FIG. 6 illustrates a roller section as viewed from above (proximal side in a Z direction)
Figure 7:
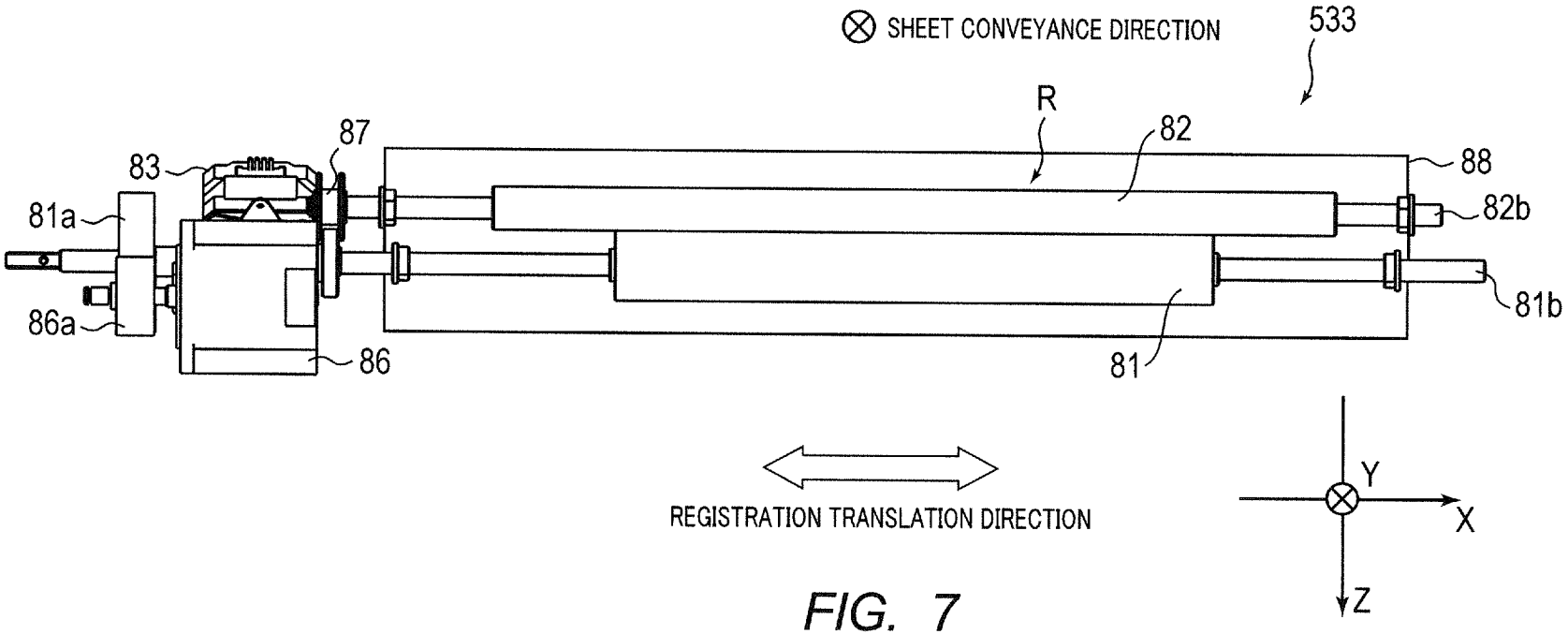
FIG. 7 illustrates the roller section as viewed from an upstream side in a sheet conveyance direction (proximal side in a Y direction)

FIG. 6 illustrates roller section 533 as viewed from above (from the proximal side in a Z direction). FIG. 7 illustrates roller section 533 as viewed from the upstream side in the sheet conveyance direction (from the proximal side in a Y direction). In FIGS. 6 and 7, the X axis corresponds to the horizontal direction (the axial direction of the rollers), the Z axis to the vertical direction, and the Y axis to the sheet conveyance direction orthogonal to the X axis and Z axis.

As illustrated in FIGS. 6 and 7, roller section 533 has a pair of rollers R composed of drive roller 81 and driven roller 82 disposed in facing relation to drive roller 81. For example, drive roller 81 is composed of a rubber roller and driven roller 82 is composed of a metal roller. Driven roller 82 is kept in a state where it is in pressure contact with drive roller 81 at all times. Driven roller 82 makes pressure contact with drive roller 81, thus forming a nip portion (registration nip) for conveying the sheet in a tightly sandwiching manner.

Drive roller 81 and driven roller 82 are each inserted in a bearing formed in frame 88 and thus rotatably fixed. By translating frame 88 in a vertical direction or a horizontal direction with drive roller 81 and driven roller 82 fixed, the axial direction can be adjusted while maintaining the positional relationship of drive roller 81 and driven roller 82.

Roller shaft 81*b* of drive roller 81 and roller shaft 82*b* of driven roller 82 are coupled by coupling member 87. Thus, when correcting the lateral position of the sheet, drive roller 81 and driven roller 82 are laterally translated together.

Drive roller 81 is connected to driving motor 86 via a power transmission section including gears 81*a* and 86*a*. Gear 81*a* has a predetermined length so as to allow transmission of a driving forth even when drive roller 81 moves in the axial direction during the registration translation. When the driving forth of driving motor 86 is transmitted to drive roller 81 via gears 86*a* and 81*a*, drive roller 81 and driven roller 82 are rotated. A sheet conveyance operation (driving of driving motor 86) in roller section 533 is controlled by control section 100.

In addition, drive roller 81 is connected to translation motor 83 via power transmission 84 composed of rack 84*b* and pinion 84*a*. That is, the displacement correction section, which translates rollers R in the lateral direction of sheets by using power transmission 84 and translation motor 83 to correct the lateral position of sheets, is composed.

Rack 84*b* is a cylindrical member having a bearing therein, and roller shaft 81*b* is inserted to rack 84*b*. Both ends of rack 84*b* are sandwiched with two washers (for example, E-shaped rings) fixed to roller shaft 81*b*, whereby rack 84*b* is fixed in the vicinity of gear 81*a*. That is, rack 84*b* is fixed so as not to translate in the axial direction while allowing the rotation of drive roller 81.

On the downstream side of roller section 533 in the sheet conveyance direction, displacement detection sensor 85 that determines the lateral position (displacement) of a sheet passing through the rollers R is disposed. Displacement detection sensor 85 is disposed in parallel with rollers R in a region on the downstream side of rollers R in sheet conveyance direction in frame 88.

Displacement detection sensor 85 is composed of a line sensor in which, for example, image receiving devices are arranged side by side in a single horizontal row (or in a plurality of horizontal rows), and is configured to detect the lateral position of an end portion of the sheet. When displacement detection sensor 85 is composed of a line sensor, the displacement amount (deviation from a reference position) of the sheet can be detected with a high accuracy (for example, in a unit of several tens of micrometers).

It is to be noted that an image sensor in which image receiving elements are disposed in a matrix may be applied as displacement detection sensor 85.

Displacement detection sensor 85 turns on lighting (for example, LED) when a sheet passes through a detection region, and captures the image of the sheet by the image receiving elements, thereby determining the lateral displacement amount of the sheet. To be more specific, displacement detection sensor 85 captures the image at the time when the leading edge of the sheet reaches thereto, thereby determining displacement amount ΔX1 of the sheet prior to the displacement correction. Displacement amount ΔX1 thus determined is a required translation amount.

In addition, displacement detection sensor 85 captures the image at the time when the displacement correction section completes the displacement correction, thereby determining the displacement amount ΔX2 of the sheet after the displacement correction. When the sheet has been translated by the required translation amount by the displacement correction, displacement amount ΔX2 of the sheet after the displacement correction is "0." By comparing displacement amounts ΔX1 and ΔX2 obtained before and after the displacement correction of the sheet, the actual sheet translation amount can be computed.

As described above, in the present embodiment, displacement detection sensor 85 as a displacement detection section that determines the lateral position of the sheet passing through rollers R functions also as a translation amount determination section that determines the translation amount of the sheet during the displacement correction. This makes it unnecessary to additionally provide a sensor for the translation amount determination section. Thus, the cost of the apparatus can be reduced and the present invention can be achieved with a simple configuration.

Figure 1:
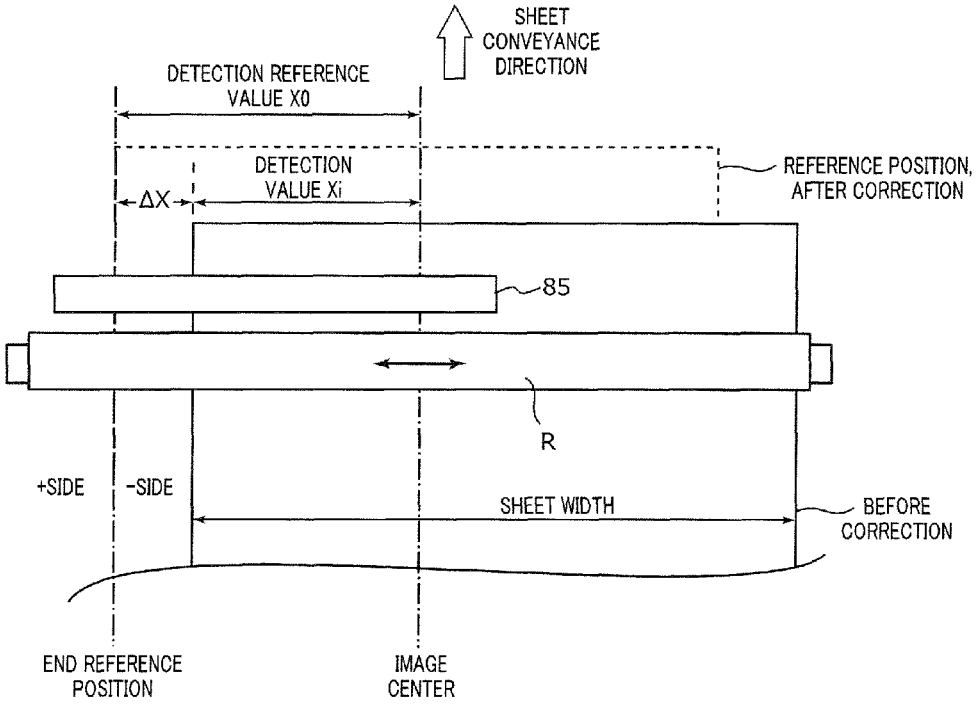
FIG. 1 PRIOR ART
FIG. 1 illustrates a roller section having a registration translation function.
Figure 2:
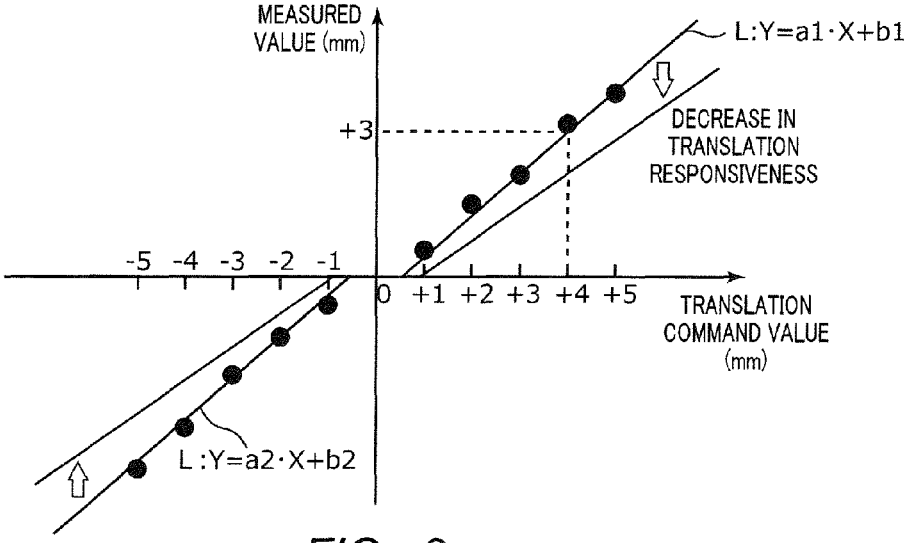
FIG. 2 PRIOR ART
FIG. 2 illustrates a relationship (translation responsiveness) between a translation command value and a measured value.
Figure 3:
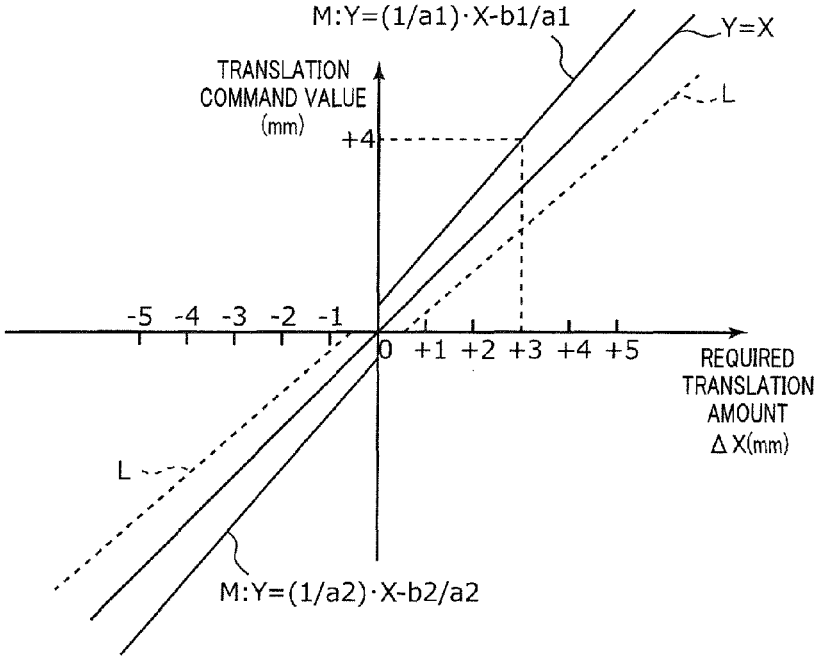
FIG. 3 PRIOR ART
FIG. 3 illustrates a translation control line that defines a translation control table.

The displacement amount determined by displacement detection sensor 85 is defined by, for example, the deviation amount from a predetermined end reference position (translation target position) (see FIG. 1). The end reference position corresponds to the position remote from the image center (the center in the lateral direction of the sheet) by half of the sheet width in the lateral direction. In addition, the writing range of the image is set on the basis of the position of the image center and the sheet width. The position of the image center and the writing range of the image are set at shipment of the image forming apparatus, for example.

Control section 100 drives translation motor 83 on the basis of the detection result obtained by displacement detection sensor 85, and controls the translating operation of rollers R. At this time, control section 100 refers to the translation control table stored in storage section 72 to obtain a translation command value corresponding to the required translation amount, and drives translation motor 83 in accordance with the translation command value.

The rotational movement of translation motor 83 is converted to a linear movement by pinion 84*a* and rack 84*b*, and transmitted to drive roller 81. Thus, rollers R composed of drive roller 81 and driven roller 82 are translated by a predetermined amount (translation amount corresponding to the translation command value) in the axis direction.

Drive roller 81 and driven roller 82 translate in the lateral direction of the sheet while rotating, that is, while conveying the sheet, whereby the lateral position of the sheet is corrected. Thus, an image is formed at a predetermined position of the sheet.

It is to be noted that, when the detection result obtained by displacement detection sensor 85 is not within the range which can be corrected by the registration translation, the lateral position of the sheet cannot be completely corrected, and therefore jam occurs and the image forming process is stopped.

Image forming apparatus 1 according to the present embodiment includes: image forming section 40 configured to form an image on a sheet; rollers R disposed on an upstream side of the image forming section 40 in a sheet conveyance direction, rollers R being configured to convey the sheet to the image forming section 40; a displacement detection section (displacement detection sensor 85) configured to detect a lateral position of the sheet passing through rollers R; a displacement correction section (translation motor 83, power transmission 84) configured to translate rollers R in a lateral direction of the sheet, and reset the lateral position of the sheet to a reference position; a translation amount determination section (displacement detection sensor 85) configured to detect a translation amount of the sheet during a displacement correction performed by displacement correction sections (83, 84); and control section 100 configured to refer to a translation control table in which a required translation amount for resetting the sheet to the reference position and a translation command value for operating displacement correction sections (83, 84) to translate the sheet by the required translation amount are associated with each other, operate operating displacement correction sections (83, 84) in accordance with a translation command value corresponding to a detection result obtained by displacement detection section (85).

In image forming apparatus 1, the displacement correction is performed in accordance with the translation command value corresponding to the required translation amount and thus the sheet is translated by the required translation amount, and therefore, the sheet is supposed to be conveyed at the reference position. However, when the translation responsiveness decreases with time due to the degradation of the components of the registration translation mechanism (which include rollers R and the bearings of rollers R), the sheet is not translated by the required translation amount, and thus the sheet may not be conveyed at the reference position. To solve such a problem, in the present embodiment, the translation control table is updated at a predetermined timing in accordance with the operating condition of image forming apparatus 1.

Figure 8:
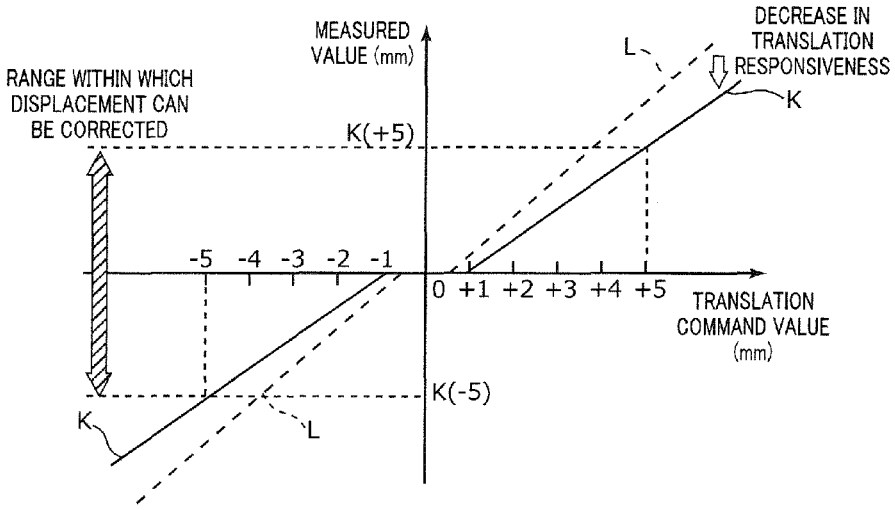
FIG. 8 illustrates a displacement correction range when a translation responsiveness is reduced.

Here, as illustrated in FIG. 8, in the case where the translation responsiveness is represented by translation response line K, when the translation range of rollers R (the upper limit and lower limit of translation command value) is −5 mm to +5 mm, the displacement correction range is K(−5) to K(+5). The translation range of rollers R is set in advance, and thus the displacement correction range after the update of the translation control table is narrow in comparison with the displacement correction range before the update.

Figure 9:
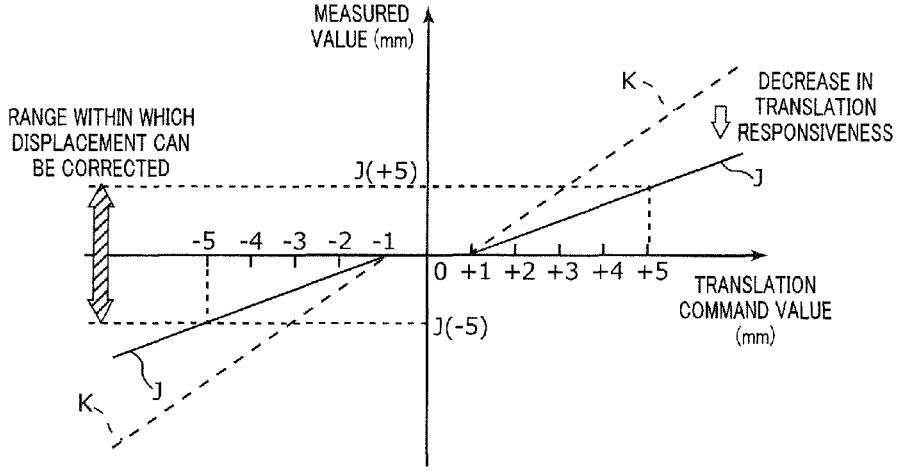
FIG. 9 illustrates a displacement correction range when the translation responsiveness is further reduced.

As illustrated in FIG. 9, as the translation responsiveness further decreases when the degradation of the components of the registration translation mechanism proceeds, the displacement correction range also decreases. That is, the displacement correction range in the case where the translation responsiveness is represented by translation response line J is J(−5) to J(+5). In this case, even when the translation control table is updated, a displacement of a sheet in a certain range (for example, −2 mm to +2 mm) cannot be surely corrected. In addition, even if the translation control table is updated, then rollers R are driven beyond the translation range, causing malfunction.

Under such circumstances, in the present embodiment, the update of the translation control table is prohibited in the case where the translation responsiveness is reduced and the displacement correction cannot be performed even after the translation control table is updated. Then, replacement of the components is requested so that the user immediately replaces the components of the registration translation mechanism.

Figure 10:
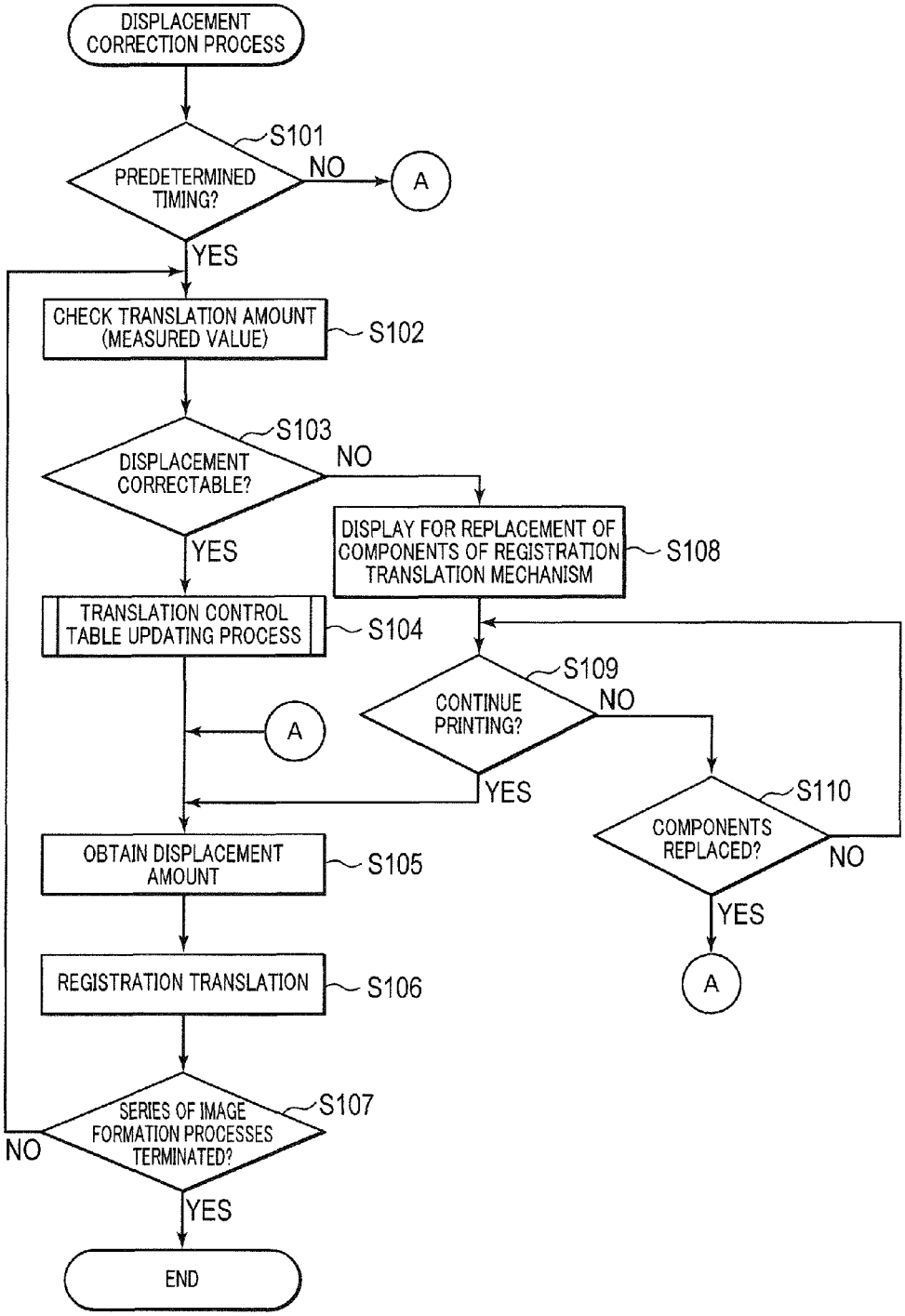
FIG. 10 is a flowchart illustrating an exemplary translation correction process.

FIG. 10 is a flowchart illustrating an exemplary displacement correction process. The displacement correction process illustrated in FIG. 10 is achieved when CPU 101 executes a predetermined program stored in ROM 102 as an image formation process is started, for example. It is to be noted that the translation control table to be referenced is changed in accordance with the sheet type and use condition during the image formation.

At step S101 of FIG. 10, control section 100 determines whether the total number of printed sheets in image forming apparatus 1 has reached a predetermined amount. The predetermined amount is set to, for example, 10,000 sheets. The total number of printed sheets is counted by CPU 101 and stored in RAM 103, for example.

When the total number of printed sheets has reached the predetermined amount ("YES" at step S101), the process is advanced to step S102. On the other hand, when the total number of printed sheets has not reached the predetermined amount ("NO" at step S101) the process is advanced to step S105, and a normal translation correction process is performed.

It is to be noted that, when the predetermined timing is in the middle of a series of image formation processes, the image formation is interrupted. The term "series of image formation processes" refers to processes for forming images for the number of sheets set by a signal (for example, printing job) requesting the image formation.

At step S102, control section 100 measures a registration amount (measured value) acquired with a certain translation command value. For example, as the certain translation command value, a registration amount acquired with the upper limit value (for example, +5 mm) of the translation command value is obtained. To be more specific, control section 100 conveys a sheet while shifting the sheet from the reference position by +5 mm, and obtains the registration amount of the sheet in the same manner as steps S122 to S124 of FIG. 11 described later.

At step S103, control section 100 determines, on the basis of the sheet registration amount obtained at step S102, whether a displacement of a sheet in a certain range is correctable, or in other words, whether the components of the registration translation mechanism are still usable.

For example, control section 100 uses the upper limit of a displacement of a sheet in a certain range as a threshold value, and compares the threshold value with the registration amount of the sheet acquired with the upper limit of the translation command value. When the registration amount of the sheet acquired with the upper limit of the translation command value is equal to or greater than the threshold value, the displacement of the sheet in the certain range can be corrected by translating rollers R in the translation range. That is, the upper limit of the translation command value is used as a certain threshold value for determining whether the displacement of the sheet in the certain range is correctable, whereby an appropriate determination can be easily performed.

When the registration amount of the sheet acquired with the upper limit of the translation command value is equal to or greater than the threshold value, control section 100 determines that the displacement of the sheet in the certain range is correctable, and when the registration amount of the sheet acquired with the upper limit of the translation command value is smaller than the threshold value, control section 100 determines that the displacement of the sheet in the certain range is not correctable. When the displacement of the sheet in the certain range is correctable ("YES" at step S103), the process is advanced to step S104, and the translation control table updating process is performed. On the other hand, when the displacement of the sheet in the certain range is not correctable ("NO" at step S103), the process is advanced to step S108.

Figure 11:
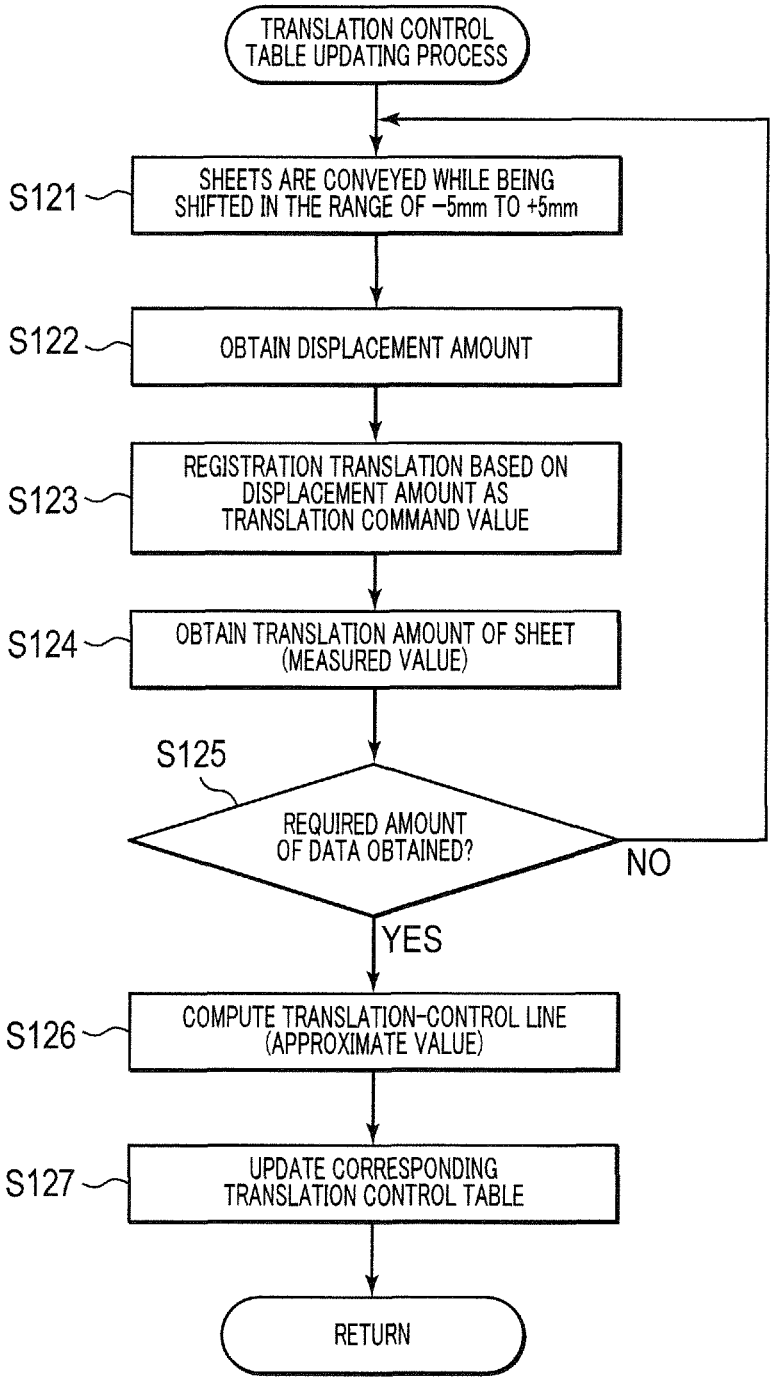
FIG. 11 is a flowchart illustrating an exemplary translation control table updating process.

The translation control table updating process at step S104 is performed in accordance with the flowchart illustrated in FIG. 11. That is, at step S121 of FIG. 11, control section 100 conveys sheets while shifting the sheets from the reference position, within the range of −5 mm to +5 mm. For example, sheets are sequentially conveyed at positions shifted from the reference position to + side at 1 mm intervals (+1 mm, +2 mm, . . . +5 mm), and thereafter, the sheets are sequentially conveyed at positions shifted from the reference position to − side at 1 mm intervals (−1 mm, −2 mm, . . . −5 mm) The sheet thus conveyed is inverted by second conveyance section 54, and again conveyed while being shifted to a predetermined position. That is, the sheet is conveyed in such a manner that the first surface (front surface) is firstly used as the image formation surface, and then the second surface (rear surface) is used as the image formation surface. At this time, it is also possible that the sheet is inverted after an image of a predetermined coverage is formed on the first surface of the sheet.

It is to be noted that the conveyed sheet is intended to obtain data used for creating the translation control table, and is ejected out of the apparatus as it is.

At step S122, control section 100 obtains a displacement amount of a sheet prior to the displacement correction on the basis of the detection results of displacement detection sensor 85 (displacement detection section) obtained at the time when the leading edge of the sheet reaches thereto.

At step S123, control section 100 reads the translation command value corresponding to the displacement amount (required translation amount) out of the currently-used translation control table, and performs the registration translation operation in accordance with the translation command value. This process is intended to recognize the actual sheet translation amount corresponding to the translation command value, and therefore the displacement amount itself may be used as the translation command value.

At step S124, control section 100 obtains the actual sheet translation amount on the basis of the detection results of displacement detection sensor 85 (translation amount determination section) obtained at the time when the displacement correction is terminated. To be more specific, the displacement amount of the sheet prior to the displacement correction which is detected at step S122 is compared with the displacement amount after the displacement correction which is detected at step S114, whereby the actual sheet translation amount is computed.

At step S125, control section 100 determines whether a required amount of data (sheet translation amount corresponding to the translation command value (measured value)) has obtained. The term "required amount of data" refers to data enough to obtain the translation response line which correctly reflects the current translation responsiveness in the range of −5 mm to +5 mm. For example, for the case where sheets are conveyed at a plurality of positions obtained by equally dividing the range of −5 mm to +5 mm at a predetermined interval (for example, 1 mm), at least one piece of data, preferably a plurality of pieces of data, is obtained. When a plurality of pieces of data are to be obtained, it suffices to convey a plurality of sheets at respective positions and perform the registration translation operation (step S123). Thus, the current translation responsiveness can be correctly reflected on the translation response line.

When the required amount of data has obtained ("YES" at step S125), the process is advanced to step S126. On the other hand, when the required amount of data has not collected ("NO" at step S125), the process is advanced to step S121. Then the processes of steps S121 to S125 are repeated.

For example, first, data of a case where a sheet is conveyed while being shifted from the reference position to + side by 1 mm is obtained, and after the same sheet is inverted, data of a case where the sheet is again conveyed while being shifted from the reference position to + side by 1 mm is obtained. Next, data of a case where a sheet is conveyed while being shifted from the reference position to + side by 2 mm is obtained, and after the same sheet is inverted, data of a case where the sheet is again conveyed while being shifted from the reference position to + side by 2 mm is obtained. In this manner, the required amount of data is obtained when data of a case where a sheet is conveyed while being shifted from the reference position to − side by 5 mm is obtained, and after the same sheet is inverted, data of a case where the sheet is again conveyed while being shifted from the reference position to − side by 5 mm is obtained.

Figure 12:
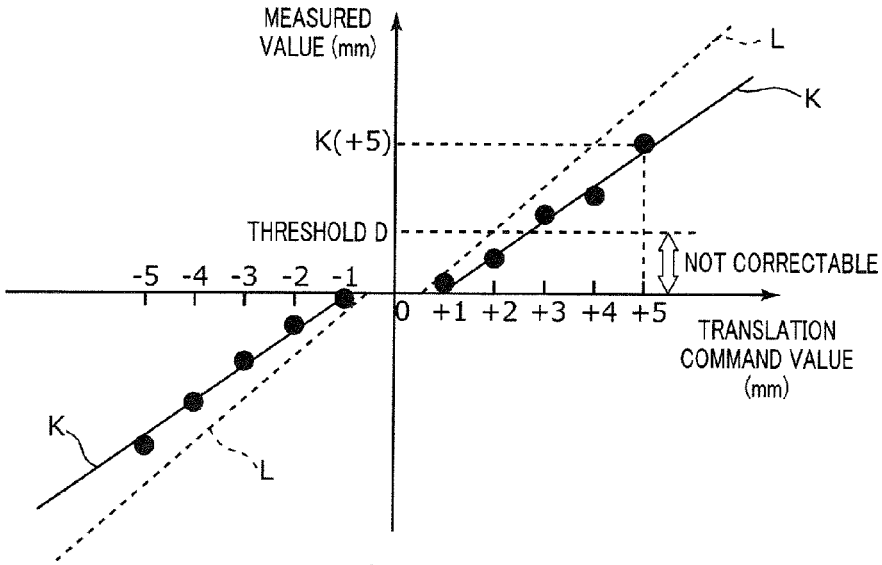
FIG. 12 illustrates a translation response line obtained by the translation control table updating process.

At step S126, control section 100 computes a translation response line on the basis of the data obtained at steps S121 to S125. For example, translation response line K is obtained as illustrated in FIG. 12. Translation response line K has a lower translation responsiveness (smaller sheet translation amount (measured value) corresponding to the translation command value) in comparison with the translation response line L on which the current translation control table is based.

Figure 13:
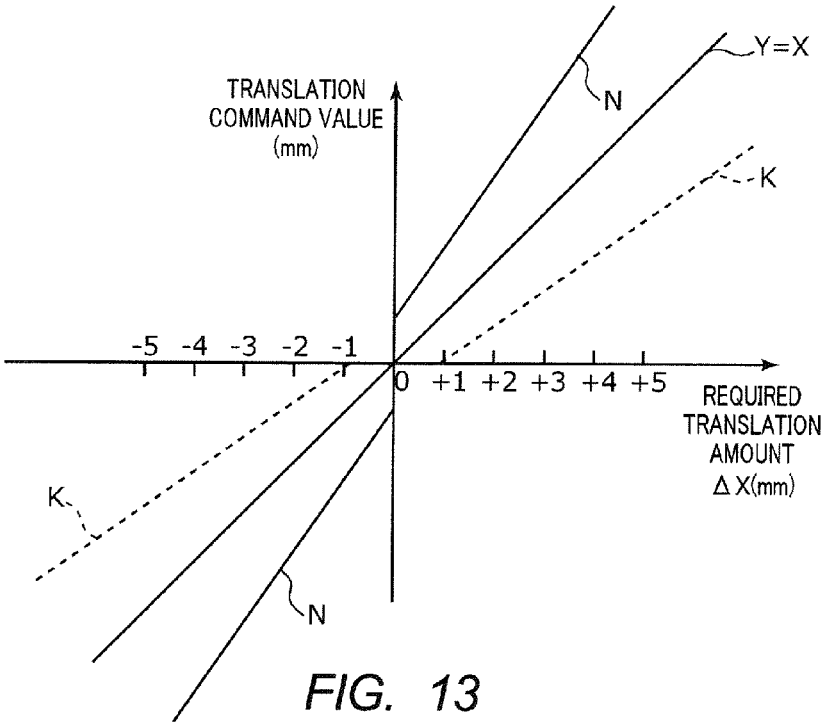
FIG. 13 illustrates a translation control line obtained by the translation control table updating process.

At step S127, on the basis of translation control line N provided by the inverse function of translation response line K computed at step S126 (see FIG. 13), control section 100 updates the relevant translation control table. After the update of the translation control table, the process is advanced to step S105 of FIG. 10, and the image formation process is started (or resumed, when the process has been interrupted).

At step S105 of FIG. 10, control section 100 starts (resumes) to convey the sheet, and on the basis of the detection results of displacement detection sensor 85 obtained at the time when the leading edge of the sheet reaches thereto, obtains the displacement amount of the sheet.

At step S106, control section 100 reads the translation command value corresponding to the displacement amount (required translation amount) out of the translation control table, and performs the registration translation operation in accordance with the translation command value. Since the translation control table is latest which reflects the temporal variation of the translation responsiveness, the lateral position of a sheet is surely reset to the reference position.

At step S107, control section 100 determines whether the series of the image formation processes have been terminated. When the series of the image formation processes have been terminated ("YES" at step S107), the displacement correction process is terminated. On the other hand, when the series of the image formation processes have not been terminated ("NO" at step S107), the processes subsequent to step S101 are repeated.

When it is determined at step S103 that the displacement of the sheet in the certain range is not correctable, control section 100 controls operation display section 20 to display a screen that requests replacement of the components of the registration translation mechanism, at step S108. In this case, the update of the translation control table is not performed.

It is to be noted that the screen that requests replacement of the components of the registration translation mechanism includes an operation button that allows the user to select whether to continue the image forming operation.

As described, control section 100 provides a notification that requests replacement of the components of the displacement correction section (components of the registration translation mechanism) when the displacement of the sheet in the certain range is not correctable. This allows the user to easily recognize that the life of the components of the registration translation mechanism has ended, and replacement is required.

At step S109, control section 100 determines whether to continue the image forming operation. This determination is performed on the basis of the user operation at operation display section 20. That is, while control section 100 prohibits the image forming operation for the sheet when the displacement of the sheet in the certain range is not correctable, control section 100 may withdraw the prohibition against the image forming operation for the sheet on the basis of the user operation.

Since the image forming operation is prohibited when the displacement of the sheet in the certain range is not correctable, it is possible to prevent a failure that an image is not formed in the desired region of the sheet when an appropriate displacement correction has not performed. In addition, since the prohibition of the image forming operation can be withdrawn, it is possible to deal with the case where productivity is prioritized over image quality. In either case, the components of the registration translation mechanism are preferably replaced at an early stage.

When the image forming operation is continued ("YES" at step S109), the process is advanced to step S105, and the translation correction process subsequent to step S105 is performed. In this case, at step S106, the currently-used translation control table is referenced. It is preferable to display the screen that requests replacement of the components of the registration translation mechanism also during the image forming operation. In addition, when the components of the registration translation mechanism has replaced, the translation control table is set again. For example, it is possible to set the initial translation control table which is prepared at the manufacturing stage of image forming apparatus 1, and it is also possible to perform the translation control table updating process of step S104 and again set the translation control table. On the other hand, when the image forming operation is not continued ("NO" at step S109), the process is advanced to step S110.

At step S110, control section 100 determines whether the components of the registration translation mechanism has replaced. When the components of the registration translation mechanism has replaced ("YES" at step S110), the process is advanced to step S105, and the translation correction process subsequent to step S105 is performed. In this case, the translation control table is set again, and referenced at step S106. When the components of the registration translation mechanism is not replaced ("NO" at step S110), the process is advanced to step S109.

As described, in image forming apparatus 1 according to the present embodiment, control section 100 obtains the relationship between the translation command value and the sheet registration amount (translation responsiveness) at a predetermined timing ("YES" at step S101 of FIG. 10), and updates the translation control table on the basis of the relationship (step S104 of FIG. 10 and FIG. 11). Further, when updating the translation control table, control section 100 determines whether a displacement of a sheet in a certain range can be corrected by the update of the translation control table (step S103 of FIG. 10), and updates the translation control table when the displacement of the sheet is correctable (step S104 of FIG. 10) but does not update the translation control table when the displacement of the sheet is not correctable ("NO" at step S103 of FIG. 10).

To be more specific, control section 100 sets a threshold value corresponding to a certain translation command value, and compares the threshold value with the registration amount of a sheet which is translated by the certain translation command value, to thereby determine whether the displacement of the sheet in the certain range is correctable (step S103 of FIG. 10).

According to image forming apparatus 1, even when the components of the registration translation mechanism is degraded because of the operating condition, an appropriate displacement correction can be performed and an image and a sheet can be precisely aligned. In addition, the components of the registration translation mechanism can be used as much as possible. In other words, in comparison with the case where the components of a registration translation mechanism are replaced according to a running condition set in advance (for example, the total number of printed sheets is 1,000,000), it is possible to achieve a considerably prolonged replacement time, and a prolonged life of the components of the registration translation mechanism. Thus, increase in CPP can be limited.

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, while the upper limit of a displacement of a sheet in a certain range is used as a threshold value, and the threshold value is compared with the registration amount of the sheet acquired with the upper limit of the translation command value in the embodiment, it is also possible to use the lower limit value of the displacement of the sheet in the certain range as a threshold value and compare the threshold value with the registration amount of the sheet acquired with the lower limit of the translation command value.

In addition, it is also possible to set threshold values respectively corresponding to a plurality of translation command values, and compare the threshold values with the registration amounts of the sheet acquired with the translation command values, so as to comprehensively determine whether the displacement of the sheet in the certain range is correctable.

Further, it is also possible to compare the threshold value with the average value of registration amounts of a plurality of sheets which are translated by a certain translation command value.

For example, while displacement detection sensor 85 as the displacement detection section also functions as the translation amount determination section in the embodiment, a sensor (for example, a line sensor) that functions as the translation amount determination section may be additionally provided.

In addition, while the translation control table is set in accordance with the type of the sheet (such as basis weight, sheet size) and the use condition (temperature and humidity) and updated at a predetermined timing in the embodiment, the translation control table may be created and updated every time when the type of sheet and the use condition are changed.

In the case where the translation control table is created at the timing when the type of sheet is changed, it is possible to determine whether the type of sheet has changed on the basis of the sheet setting operation by the user from operation section 22, or information relating to the sheet which is included in the printing job, for example.

In the case where the translation control table is created at the timing when the use condition is changed, it is possible to determine that the use condition is changed when the temperature or humidity is changed to a predetermined value or above during a certain period, for example.

Further, the information relating to the predetermined timing for the translation control table updating process may be set in advance at the manufacturing stage, or set by the user operation from operation section 22. The "information relating to the predetermined timing" includes the type of the predetermined timing (the timing when the total number of printing reaches a predetermined amount, the timing when the sheet type is changed, the timing when the use condition is varied, and the like), and the condition for determining whether the predetermined timing is reached.

The embodiment disclosed herein is merely an exemplification and should not be considered as limitative. The scope of the present invention is specified by the following claims, not by the above-mentioned description. It should be understood that various modifications, combinations, subcombinations and alterations may occur depending on design requirements and other factors in so far as they are within the scope of the appended claims or the equivalents thereof.

What is claimed is:

1. An image forming apparatus comprising:

an image forming section configured to form an image on a sheet;

a pair of rollers disposed on an upstream side of the image forming section in a sheet conveyance direction, the rollers being configured to convey the sheet;

a displacement detection section configured to detect a lateral position of the sheet passing between the rollers;

a displacement correction section configured to translate the rollers in a lateral direction of the sheet, and reset the lateral position of the sheet to a reference position;

a translation amount determination section configured to determine a translation amount of the sheet during a displacement correction performed by the displacement correction section; and a control section configured to refer to a translation control table in which a required translation amount for resetting the sheet to the reference position and a translation command value for operating the displacement correction section to translate the sheet by the required translation amount are associated with each other, operate the displacement correction section in accordance with a translation command value corresponding to a detection result obtained by the displacement detection section, obtain at a predetermined timing a relationship between the translation command value and a translation amount of the sheet, and update the translation control table on the basis of the relationship, wherein when updating the translation control table, the control section determines whether a displacement of a sheet in a certain range is correctable by the update of the translation control table, and the control section updates the translation control table when the displacement of the sheet is correctable, but does not update the translation control table when the displacement of the sheet is not correctable.

2. The image forming apparatus according to claim 1, wherein the control section sets a threshold value corresponding to a certain translation command value, and compares the threshold value with a registration amount of a sheet which is translated by the certain translation command value to determine whether the displacement of the sheet in the certain range is correctable.

3. The image forming apparatus according to claim 2, wherein the certain translation command value is an upper limit value or a lower limit value of a translation range of the displacement correction section.

4. The image forming apparatus according to claim 2, wherein the control section compares the threshold value with an average value of translation amounts of a plurality of sheets which are translated by the certain translation command value.

5. The image forming apparatus according to claim 1, wherein, when the displacement of the sheet in the certain range is not correctable, the control section provides a notification that requests replacement of components of the displacement correction section.

6. The image forming apparatus according to claim 1, wherein, when the displacement of the sheet in the certain range is not correctable, the control section prohibits an image forming operation for the sheet.

7. The image forming apparatus according to claim 6, wherein, on the basis of a user operation, the control section withdraws the prohibition against the image forming operation for the sheet.

* * * * *